US011769622B2

(12) United States Patent
Kim et al.

(10) Patent No.: US 11,769,622 B2
(45) Date of Patent: Sep. 26, 2023

(54) INDUCTOR DEVICE AND METHOD OF MANUFACTURING THE SAME

(71) Applicant: Samsung Electro-Mechanics Co., Ltd., Suwon-si (KR)

(72) Inventors: In-Seok Kim, Suwon-si (KR); Yong-Jin Park, Suwon-si (KR); Young-Gwan Ko, Seoul (KR); Youn-Soo Seo, Suwon-si (KR); Myung-Sam Kang, Hwaseong-si (KR); Tae-Hong Min, Hwaseong-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 1264 days.

(21) Appl. No.: 16/233,178

(22) Filed: Dec. 27, 2018

(65) Prior Publication Data

US 2019/0139696 A1 May 9, 2019

Related U.S. Application Data

(62) Division of application No. 15/003,925, filed on Jan. 22, 2016, now abandoned.

(30) Foreign Application Priority Data

Apr. 6, 2015 (KR) ..... 10-2015-0048218

(51) Int. Cl.
*H01F 27/32* (2006.01)
*H01F 17/00* (2006.01)
(Continued)

(52) U.S. Cl.
CPC ..... *H01F 27/32* (2013.01); *H01F 17/0013* (2013.01); *H01F 27/255* (2013.01); *H01F 41/041* (2013.01)

(58) Field of Classification Search
CPC ..... H01F 27/32; H01F 17/0013; H01F 27/255
(Continued)

(56) References Cited

U.S. PATENT DOCUMENTS 4,318,148 A 3/1982 Kaminaka et al.
6,207,234 B1 3/2001 Jiang
(Continued)

FOREIGN PATENT DOCUMENTS

CN 104900374 A * 9/2015 ..... H01F 17/0013
CN 108597730 A * 9/2018 ..... H01F 17/0006
(Continued)

OTHER PUBLICATIONS

Korean Office Action dated Apr. 6, 2016 in counterpart Korean Application No. 10-2015-0048218. (6 pages in Korean).
(Continued)

*Primary Examiner* — Marlon T Fletcher
*Assistant Examiner* — Joselito S. Baisa
(74) *Attorney, Agent, or Firm* — NSIP Law

(57) ABSTRACT

Disclosed is an inductor device and method of manufacturing the same. The inductor device includes an insulating layer, a coil pattern formed on two opposing surfaces of the insulating layer, a first insulating film and a second insulating film formed with different insulating materials on the coil pattern, and a magnetic member formed to enclose the insulating layer, the coil pattern and the first and the second insulating films. By forming thin dual insulating films having a high adhesive strength and breaking strength on an inductor coil, it is possible to improve Ls characteristics of the inductor device and increase the inductance.

26 Claims, 8 Drawing Sheets

(51) Int. Cl.
*H01F 41/04* (2006.01)
*H01F 27/255* (2006.01)

(58) Field of Classification Search
USPC ..... 336/200
See application file for complete search history.

(56) References Cited

U.S. PATENT DOCUMENTS 6,355,535 B2 * 3/2002 Liou ..... H01L 28/10 257/E21.573
6,460,974 B1 10/2002 Lebron
6,466,401 B1 * 10/2002 Hong ..... G11B 5/313 360/123.25
7,348,671 B2 3/2008 Kirby
8,797,136 B2 * 8/2014 Nakajima ..... H01F 17/0013 336/200
9,437,363 B2 * 9/2016 Choi ..... H01F 27/292
9,945,042 B2 4/2018 Cha et al.
2002/0101683 A1 * 8/2002 Katakura ..... G11B 5/17 360/123.28
2003/0151849 A1 * 8/2003 Sasaki ..... G11B 5/3136 360/123.28
2005/0068675 A1 3/2005 Sasaki et al.
2007/0254006 A1 11/2007 Loose et al.
2010/0245013 A1 9/2010 Kawabata
2011/0074535 A1 3/2011 Banno
2011/0245807 A1 10/2011 Sakata et al.
2012/0081258 A1 4/2012 Yosui et al.
2012/0126926 A1 * 5/2012 Kroener ..... H01F 41/04 336/199
2012/0282311 A1 11/2012 Schmid et al.
2013/0106552 A1 5/2013 Fontana, Jr. et al.
2013/0135074 A1 5/2013 Wi et al.
2013/0141206 A1 * 6/2013 Lee ..... H01F 17/0013 336/200
2013/0169401 A1 * 7/2013 Lee ..... H01F 27/29 29/602.1
2013/0222101 A1 * 8/2013 Ito ..... H01F 3/08 336/83
2013/0249664 A1 9/2013 Tonoyama et al.
2014/0048320 A1 2/2014 Park et al.
2014/0049350 A1 2/2014 Tseng
2014/0049353 A1 * 2/2014 Yoon ..... H01F 41/041 336/227
2014/0191838 A1 7/2014 Yoshida
2014/0225701 A1 8/2014 Morita et al.
2014/0232504 A1 8/2014 Tachibana et al.
2015/0028984 A1 * 1/2015 Kang ..... H01F 41/043 336/200
2015/0255206 A1 9/2015 Han et al.
2017/0372832 A1 * 12/2017 Choi ..... H01F 27/2804

FOREIGN PATENT DOCUMENTS

CN 113453392 A * 9/2021 ..... H01B 7/226
JP 2012-89765 A 5/2012
JP 2013-24660 A 2/2013
JP 2013024660 A * 2/2013
JP 2014-38998 A 2/2014
JP 2015082660 A * 4/2015 ..... H01F 17/0006
JP 2017017142 A * 1/2017 ..... H01F 17/0013
KR 10-2014-0024139 A 2/2014
KR 10-1474166 B1 12/2014
KR 20170090144 A * 1/2016
KR 2016102657 A * 8/2016 ..... H01F 17/0013
KR 20170090144 A * 8/2017

OTHER PUBLICATIONS

Japanese Office Action dated Oct. 1, 2019 in counterpart Japanese Patent Application No. 2016-018995 (7 pages in English and 3 pages in Japanese).

* cited by examiner

INDUCTOR DEVICE AND METHOD OF MANUFACTURING THE SAME

CROSS-REFERENCE TO RELATED APPLICATION(S)

This application is a division of application Ser. No. 15/003,925 filed on Jan. 22, 2016, which claims the benefit under 35 USC 119(a) of Korean Patent Application No. 10-2015-0048218 filed on Apr. 6, 2015 in the Korean Intellectual Property Office, the entire disclosure of which is incorporated herein by reference for all purposes.

BACKGROUND

1. Field

The following description relates to an inductor and a method of manufacturing the same.

2. Description of Related Art

An inductor device is a passive devices constituting an electronic circuit, a resistor, and a capacitor. The inductor device may be used in a power circuit, such as a DC-DC converter. The inductor device may also be used in electronic equipment, to remove noise, or to form an LC resonance circuit. As multitasking capabilities for activities such as, for example, communication, camera, and game are increasingly in today's smartphones and tablet PCs, there has been a growing use of power inductors to reduce power loss and to enhance power efficiency.

While inductor devices are of multilayer types, coil types and film types, the film type inductor devices have been increasingly used as electronic equipment have been smaller and thinner.

As the electronic equipment has become smaller and thinner, there has been a growing demand for smaller and thinner inductor devices, with a same or greater level of inductance and Q values. Accordingly, there have been ongoing efforts for developing a material such as, for example, ferrite having a higher saturation magnetization value, or increasing the area of coil wiring through a printing technique for increasing an aspect ratio between a width and a thickness of the coil wiring, or through a structural technique for forming a high aspect ratio.

The coil type inductor may be formed by winding a coil on, for example, a ferrite core. In the coil type inductor, a stray capacitance may occur in between the coil, and thus the number of coil winding have to be increased to obtain a high inductance.

The multilayer type inductor may have a plurality of ceramic sheets, which are laminated. In the multilayer type inductor, a coil type of metal pattern is formed on each ceramic sheet, and the metal patterns may be successively connected to one another through conductive vias disposed on the ceramic sheets. The multilayer type inductor is better suited for mass production and has a better high-frequency property than the coil type inductor.

The film type inductor has been increasingly studied recently because materials having a high saturation magnetization value can be utilized, it is relatively easier to form an internal circuit pattern compared to the multilayer type inductor, even if the film type inductor is manufactured in a small size.

The related art of the present description is disclosed in U.S. Patent Publication No. US 2009-0207576. All documents cited in the present disclosure, including published documents, patent applications, and patents, may be incorporated herein in their entirety by reference in the same manner as when each cited document is separately and specifically incorporated or incorporated in its entirety.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect there is provided an inductor device that may improve Ls characteristics of an inductor and increase an inductance by forming thin dual insulating films having a high adhesive strength and breaking strength on an inductor coil.

In another general aspect there is provided a method of manufacturing an inductor device that may improve Ls characteristics of an inductor and increase an inductance by forming thin dual insulating films having a high adhesive strength and breaking strength on an inductor coil.

In another general aspect there is provided an inductor device including an insulating layer, a coil pattern formed on two opposing surfaces of the insulating layer, a first insulating film and a second insulating film formed with different insulating materials on the coil pattern, and a magnetic member formed to enclose the insulating layer, the coil pattern and the first and the second insulating films.

The coil pattern may be formed in an elliptical shape.

The first insulating film may be made of a material having a greater adhesive strength than a material of the second insulating film.

The second insulating film may be made of a material having a greater breaking strength than a material of the first insulating film.

The first insulating film and the second insulating film are formed using initiated chemical vapor deposition (iCVD).

The circuit pattern and a via may be formed on the insulating layer.

The inductor device may include a pair of external terminals formed on external surfaces of the magnetic member and the pair of external terminals may be electrically connected with the coil pattern.

The inductor device may include a through hole formed to divide the insulating layer.

In another general aspect there is provided a method of manufacturing an inductor device including forming a coil pattern on two opposing surfaces of an insulating layer, forming a first insulating film and a second insulating film made of different materials on the coil pattern, and forming a magnetic member to enclose the first insulating film and the second insulating film, coil pattern, and insulating layer.

The forming of the magnetic member may include laminating a dry-film type sheet above and below the insulating layer, and pressing and curing the dry-film type sheet.

The first insulating film may be made of a material having a greater adhesive strength than a material of the second insulating film.

The second insulating film may be made of a material having a greater breaking strength than a material of the first insulating film.

The first insulating film and the second insulating film may be formed using initiated chemical vapor deposition (iCVD).

The iCVD may use a peroxide of tert-butyl peroxide (TBPO) or tert-amyl peroxide (TAPO) as an initiator.

The method may include forming a circuit pattern and a via on the insulating layer.

The method may include forming a pair of external terminals on external surfaces of the magnetic member, wherein the pair of external terminals may be electrically connected with the coil pattern.

The forming of the first insulating film may include forming the first insulating film by depositing the first insulating film on the coil pattern and a portion of the insulating layer where coil pattern is not formed.

The dry-film type sheet may be a composite of polymer with ferrite or metallic magnetic powder.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
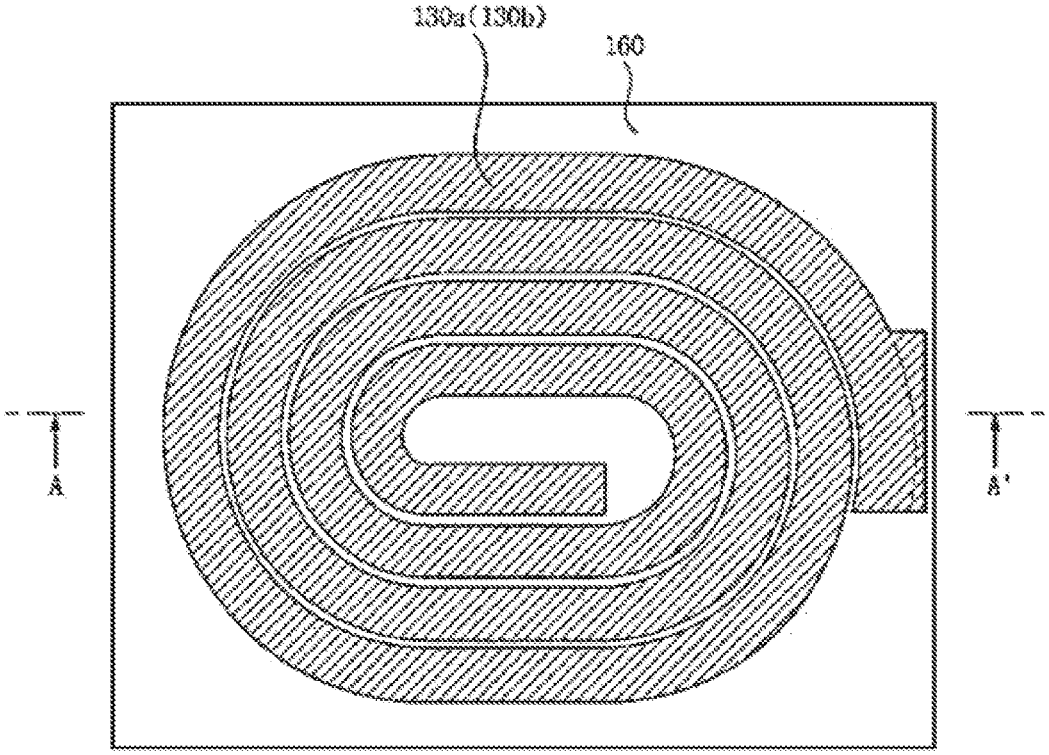
FIG. 1 is a diagram illustrating an example of an inductor device.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Identical or corresponding elements will be given the same reference numerals, regardless of the figure number, and any redundant description of the identical or corresponding elements will not be repeated. Throughout the description of the present disclosure, when describing a certain relevant conventional technology is determined to evade the point of the present disclosure, the pertinent detailed description will be omitted. Terms such as "first" and "second" can be used in describing various elements, but the above elements shall not be restricted to the above terms. The above terms are used only to distinguish one element from the other. In the accompanying drawings, some elements may be exaggerated, omitted or briefly illustrated, and the dimensions of the elements do not necessarily reflect the actual dimensions of these elements.

Figure 2:
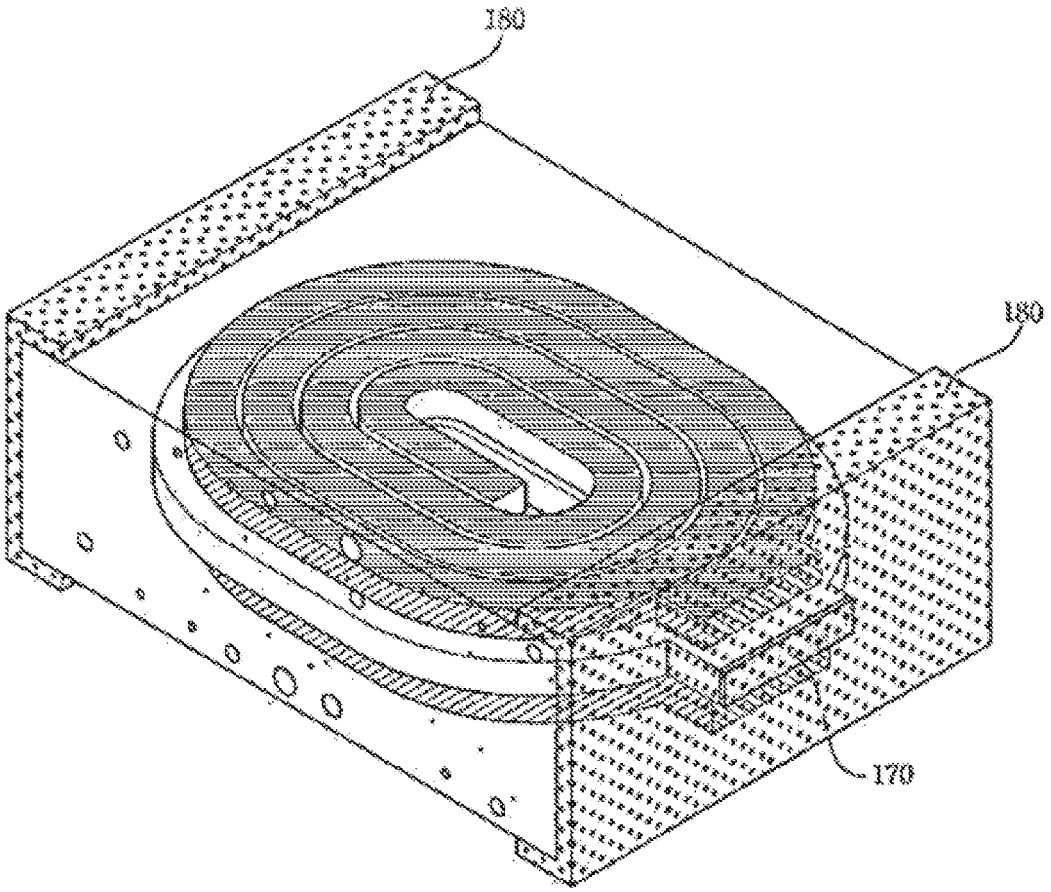
FIG. 2 is a diagram illustrating an example of the inductor device.
Figure 3:
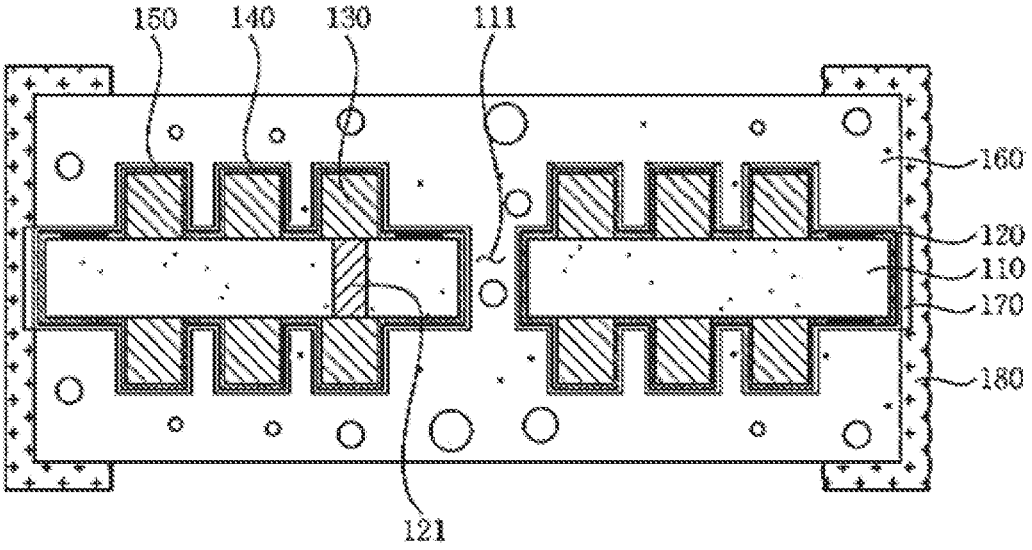
FIG. 3 is a diagram illustrating an example of the inductor device.

FIG. 1 is a diagram illustrating an example of an inductor device. FIG. 2 is a diagram illustrating an example of the inductor device. FIG. 3 is a diagram illustrating an example of the inductor device. As illustrated in FIG. 1 through FIG. 3, an inductor device includes an insulating layer 110, a coil pattern 130 formed on both surfaces of the insulating layer 110, dual insulating films 140 and 150 formed with different insulating materials on the coil pattern 130, and a magnetic member 160 for molding the aforementioned elements.

The insulating layer 110, which functions as a support layer for the coil pattern 130, has a through-hole 111 formed at a center and has a via 121. A circuit pattern 120 is formed on an upper surface and a lower surface of the insulating layer 110 for electrical connection with the coil pattern 130. In this example, since the insulating layer 110 is less magnetically permeable than a magnetic material, the through-hole 111 may inhibit a serial resistance value from increasing while preventing an inductance value from dropping due to an insufficient circulation of flux.

The insulating layer 110 may be formed as a prepreg layer, and may be made of a thermosetting or thermoplastic polymer material, a ceramic, an organic or inorganic composite material, or any resin having glass fiber impregnated therein. When the insulating layer 110 is made of a polymer resin, the polymer resin may include an epoxy insulation resin, such as, for example, flame retardant 4 (FR-4), bismaleimide triazine (BT) or an ajinomoto build-up film (ABF). In another example, the polymer resin may include a polyimide resin, but the present disclosure is not limited thereto.

The coil pattern 130 is formed with a thickness of about 100-200 μm using a conductive metallic material, such as, for example, copper, above and below the insulating layer 110. The coil pattern 130 is formed in a generally spiral structure but may be formed in a circular shape, an elliptical shape or a polygonal shape, such as, for example a rectangular, pentagonal or hexagonal shape, or in an irregular shape. However, as illustrated in FIG. 1 to FIG. 3, the coil pattern 130 may have a maximum area to maximizing the intensity of an induced magnetic field, by being formed in an elliptical shape in the inductor device.

The coil pattern 130 is connected with an input/output pattern 170 for electrical input and output. The input/output pattern 170 is formed on a lateral surface of the insulating layer 110 for electrical connection with an external terminal 180 formed outside the magnetic member 160.

The dual insulating films 140 and 150 are constituted with a first insulating film 140, which is made of a first insulating material, and a second insulating film 150, which is made of a second insulating material. The first insulating film 140 is made of a material having a greater adhesive strength than that of the second insulating film 150 to function as a seed layer on the coil pattern 130.

For example, the first insulating film 140 may be made of a material such as, for example, silane polymer, amine polymer, imidazole polymer, pyridine polymer or a combination thereof, but the present disclosure is not limited thereto.

Moreover, the second insulating film 150 is made of a material having a greater breaking strength than the first insulating film 140. For example, the second insulating film 150 may be made of a material such as, for example, a organosilicon polymer, superhydrophobic polymer, hydrophilic polymer or hydrophobic polymer, but the present disclosure is not limited thereto.

The first insulating film 140 and the second insulating film 150 are formed using initiated chemical vapor deposition (iCVD) to form a thin insulating film and to reduce a rate of wave form defects.

The magnetic member 160 may be formed by laminating a dry-film type of sheet, made of a composite of polymer with ferrite or metallic magnetic powder, above and below the insulating layer 110, on which the dual insulating films 140 and 150 are formed, or by casting a paste made of the aforementioned material.

Formed at either end of the magnetic member 160 are a pair of external terminals 180 that are electrically connected with the input/output pattern 170.

Figure 9:
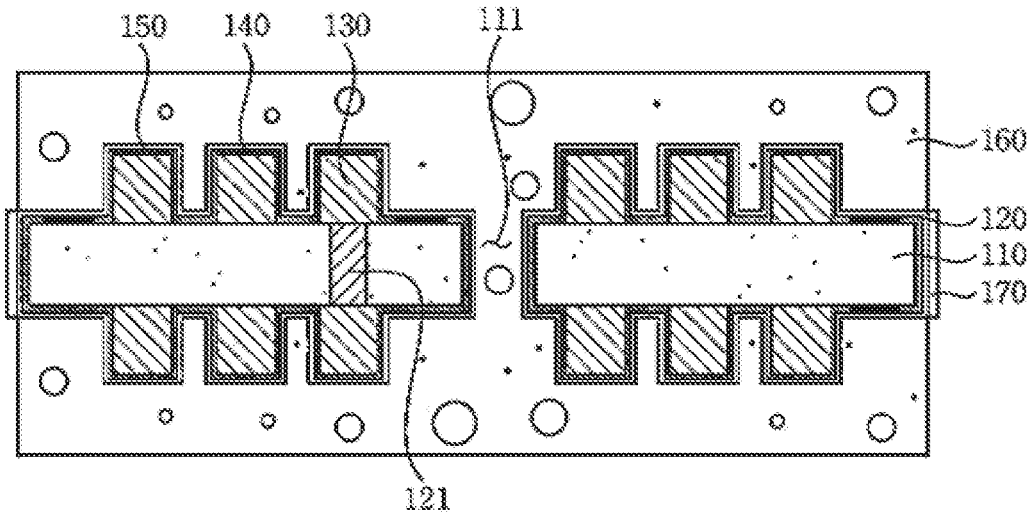
Figure 10:
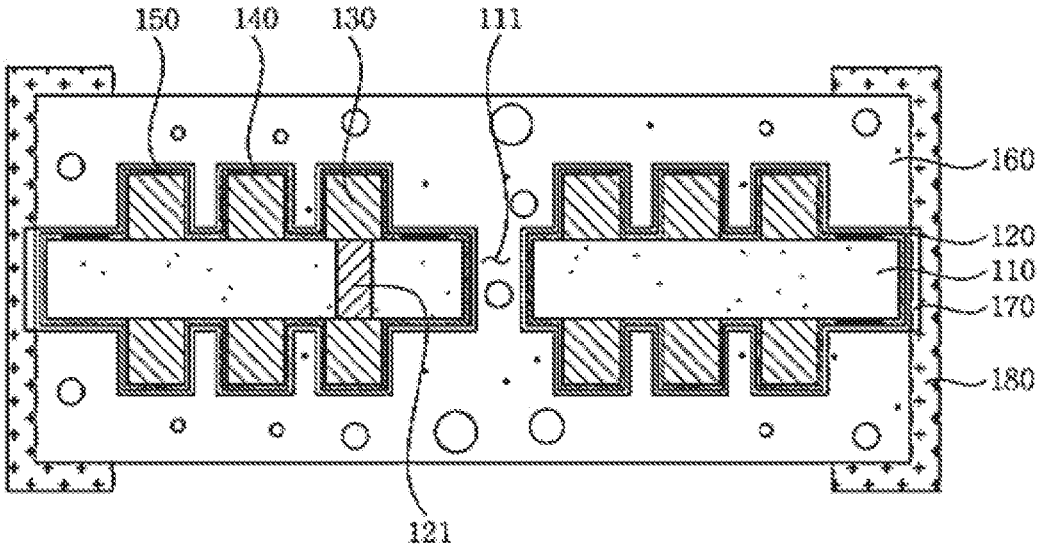
Figure 11:
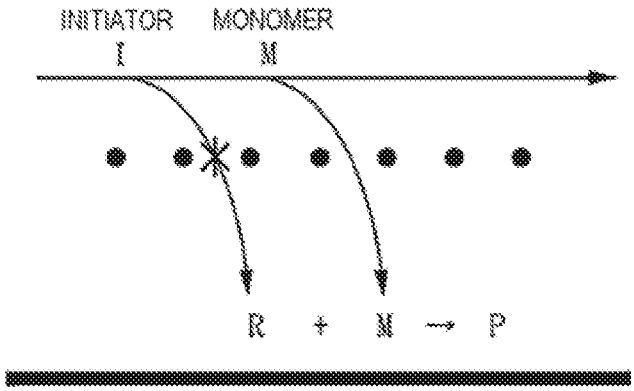
FIG. 11 illustrates an example of a principle of deposition in an Initiated Chemical Vapor Deposition (iCVD) process used in a method of manufacturing an inductor device.

FIG. 4 through FIG. 10 are diagrams illustrating examples of a method of manufacturing an inductor device. FIG. 11 illustrates an example of a principle of deposition in an iCVD process used in a method of manufacturing an inductor device. The inductor device used in this example is described above and illustrated in FIG. 1 to FIG. 3. The above description of FIGS. 1-3, is also applicable to FIGS. 4-10, and is incorporated herein by reference. Thus, the above description may not be repeated here.

Figure 4:
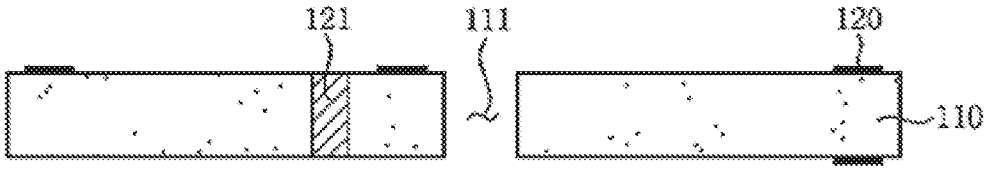
FIG. 4 through FIG. 10 are diagrams illustrating examples of a method of manufacturing an inductor device.

As illustrated in FIG. 4, a circuit pattern is formed on both surfaces of an insulating layer. A through-hole 111 is formed at a center of an insulating layer 110. A via 121 is formed in the insulating layer 110 and a circuit pattern 120 is formed on an upper surface and a lower surface of the insulating layer 110.

In this example, since the insulating layer 110 is less magnetically permeable than a magnetic material, the through-hole 111 may inhibit a serial resistance value from increasing while preventing an inductance value from dropping due to an insufficient circulation of flux. The through-hole 111 may be formed using a laser drill.

The circuit pattern 120, which is configured to apply an electric signal to a coil pattern, is formed by selectively removing a metal layer formed on the upper surface and the lower surface of the insulating layer 110. In an example, the circuit pattern 120 may be formed using a subtractive process, which is an etching process. In another example, the circuit pattern 120 may be formed using an additive process, which uses electroless and/or electrolytic copper plating, and/or a semi-additive process.

In an example, the insulating layer 110 may be formed as a prepreg layer, and may be made of a thermosetting or thermoplastic polymer material, a ceramic, an organic or inorganic composite material, or any resin having glass fiber impregnated therein. When the insulating layer 110 is made of a polymer resin, the polymer resin may include an epoxy insulation resin, such as, for example, flame retardant 4 (FR-4), bismaleimide triazine (BT), or an ajinomoto build-up film (ABF). In another example, the polymer resin may include a polyimide resin, but the present disclosure is not limited thereto.

Figure 5:
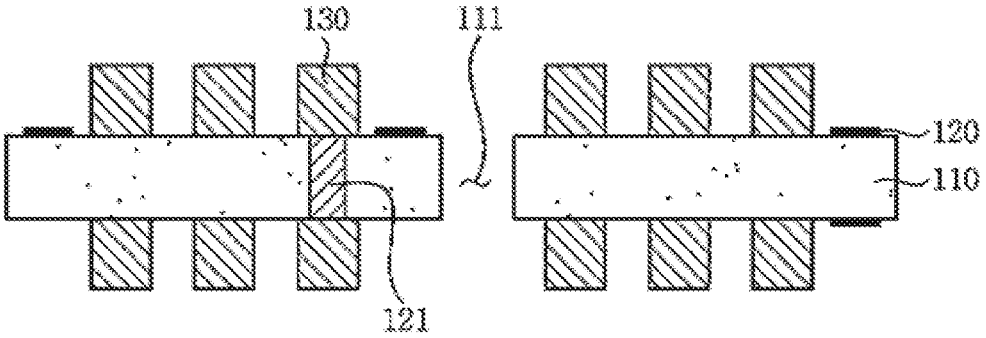

As illustrated in FIG. 5, a coil pattern 130 is formed on both surfaces of the insulating layer 110.

The coil pattern 130 is formed with a thickness of about 100-200 μm using a conductive metallic material, such as, for example, copper, above and below the insulating layer 110. In an example, the coil pattern 130 is formed by selectively removing a metal layer. In an example, the coil pattern 130 may be formed using a subtractive process, an additive process, which uses electroless and/or electrolytic copper plating, and/or a semi-additive process.

The coil pattern 130 is formed in a generally spiral structure but may be formed in a circular shape, an elliptical shape or a polygonal shape, such as, for example, rectangular, pentagonal or hexagonal shape, or in an irregular shape. As illustrated in FIG. 1 to FIG. 3, the coil pattern 130 may have a maximum area, hence maximizing the intensity of an induced magnetic field, by being formed in an elliptical shape in the inductor device.

Figure 6:
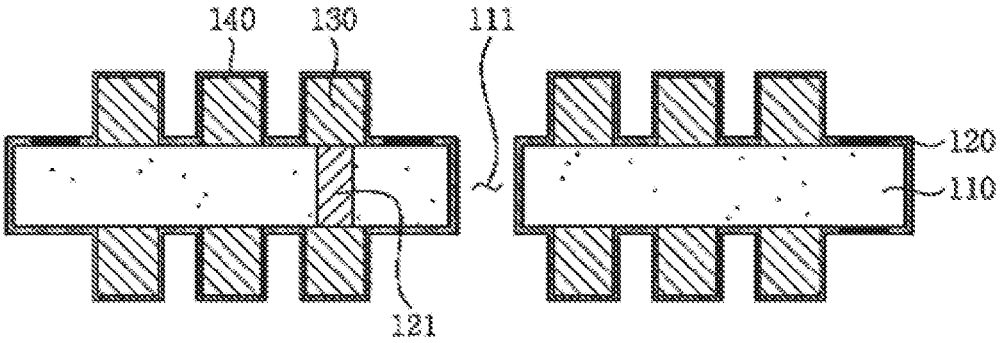

As illustrated in FIG. 6, a first insulating film 140 is formed on the coil pattern 130 using iCVD. The first insulating film 140 is made of a material having a greater adhesive strength than that of a second insulating film. The first insulating film 140 is made of a strongly adhesive insulating material to function as a seed layer on the coil pattern 130. For example, the first insulating film 140 may be made of a silane polymer, an amine polymer, an imidazole polymer, a pyridine polymer, or a combination thereof, but the present disclosure is not limited thereto.

By forming the first insulating film 140 using the iCVD method, it becomes possible to form a thin insulating film and to reduce a rate of wave form defects. As illustrated in FIG. 11, in the iCVD method, a thin polymer film P may be formed through a vapor phase polymerization, in which a deposition process and a polymerization reaction of polymer are simultaneously undertaken by vaporizing a monomer M of polymer forming an AP film within a chamber. The iCVD method may allow the thin polymer film P to be deposited on surfaces of the coil pattern 130 and the insulating layer 110 by enabling a chain polymerization reaction using a free radical R in a vapor phase by vaporizing an initiator I and the monomer M.

In this example, the initiator I and the monomer M have no polymerization reaction when the initiator I and the monomer M are simply mixed, but when the initiator I is decomposed and the radical R is generated by a hot filament placed within an iCVD chamber, the monomer M is activated, causing the chain polymerization reaction. The initiator I, for which a peroxide such as tert-butyl peroxide (TBPO) or tert-amyl peroxide (TAPO) is often used, is a volatile material having a boiling point of about 110° C. and a pyrolysis temperature of about 150° C.

By maintaining the filament used in the iCVD chamber at about 200-250° C., the chain polymerization reaction may be readily induced. In this example, the temperature of the filament is sufficiently high for pyrolysis of the peroxide initiator I but not for pyrolysis of most organic materials including the monomer M used in iCVD.

The free radical R formed through the decomposition of the initiator I may be transferred to the monomer M for chain reaction, resulting in formation of polymer P. The formed polymer P may be laminated on the insulating layer 110, which is maintained at a low temperature, to form the AP film.

Figure 7:
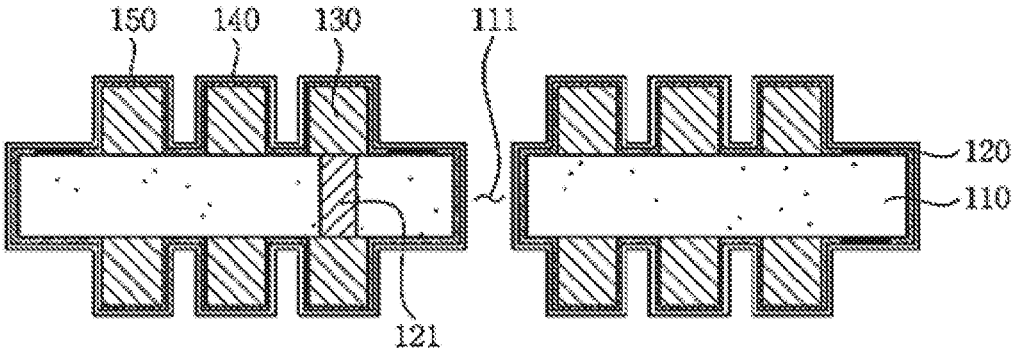

As illustrated in FIG. 7, a second insulating film 150 is formed on the first insulating film 140. The second insulating film 150 is made of a material that is stronger than the first insulating film 140, or the second insulating film 150 has a greater breaking strength than that of the first insulating film 140. For example, the second insulating film 150 may be made of a material such as, for example, organosilicon polymer, superhydrophobic polymer, hydrophilic polymer, or hydrophobic polymer, but the present disclosure is not limited thereto. Like the first insulating film 140, the second insulating film 150 is formed using iCVD.

Figure 8:
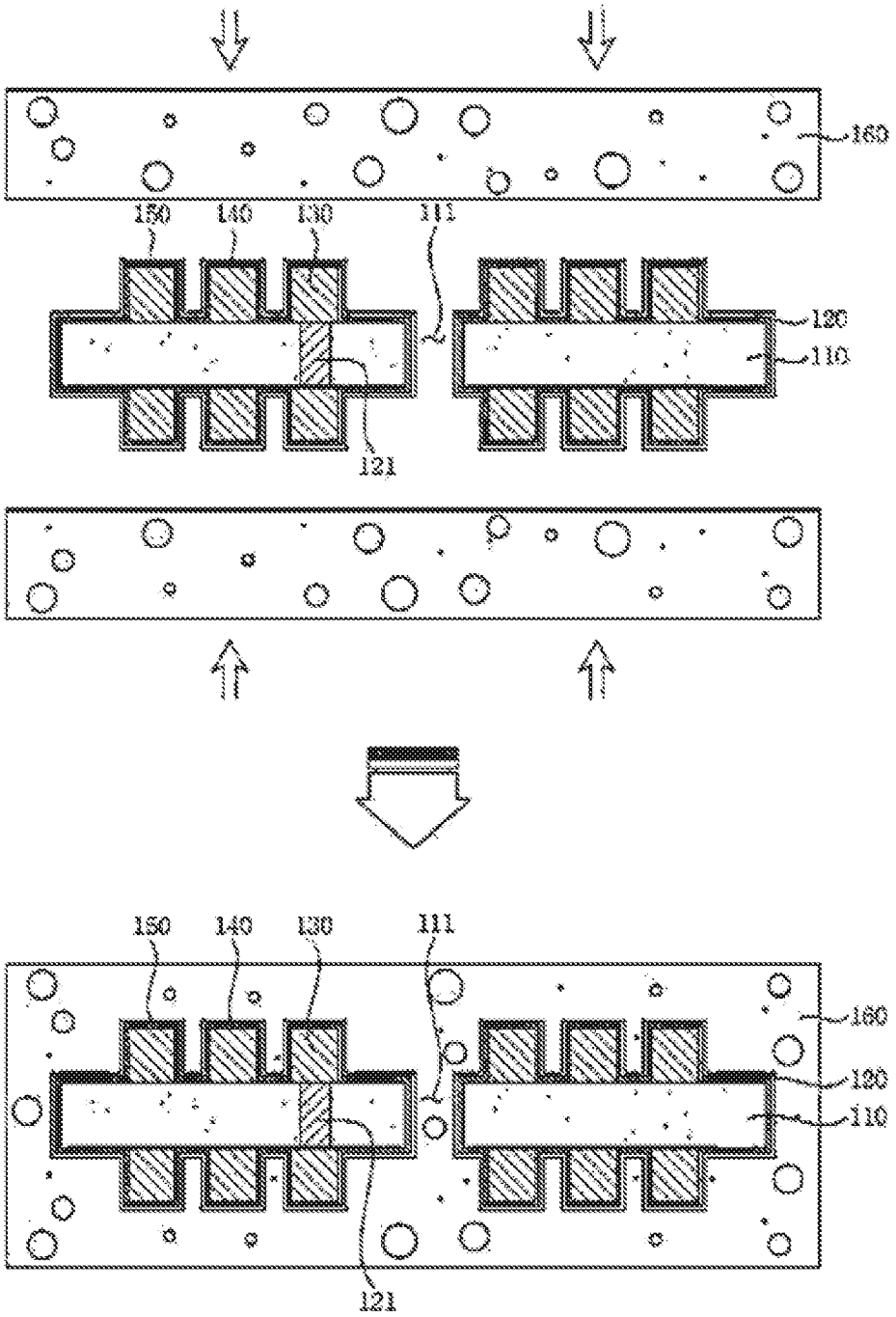

As illustrated in FIG. 8, a magnetic member 160 is formed such that the formed first insulating film 140 and second insulating film 150 are enclosed in the magnetic member 160.

In an example, the magnetic member 160 may be formed by laminating a dry-film type of sheet, made of a composite of polymer with ferrite or metallic magnetic powder, above and below the insulating layer 110, on which the first insulating film 140 and the second insulating film 150 are formed. In another example, the magnetic member 160 may be formed by casting a paste made of the aforementioned material.

After laminating the dry-film type, magnetic sheet above and below the insulating layer 110, a pressing process is carried out, followed by primary curing and secondary curing.

As illustrated in FIG. 9, dicing, polishing and grinding processes are successively carried out to expose a lateral portion of the insulating layer 110 from the cured magnetic member 160. An input/output pattern 170 is formed on the lateral portion of the insulating layer 110. The input/output pattern 170 is a coil electrode being electrically connected with the coil pattern 130, As illustrated in FIG. 10, a pair of external terminals 180, which are electrically connected with the input/output pattern 170, are formed on the end portions of the magnetic member 160.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An inductor device comprising:

an insulating layer;

a coil pattern disposed on two opposing surfaces of the insulating layer;

a first insulating film and a second insulating film formed with different insulating materials, the first insulating film surrounding a curved exterior of the coil pattern, the second insulating film is sequentially disposed over the first insulating film on the insulating layer between adjacent turns of the coil pattern; and a magnetic member disposed to enclose the insulating layer, the coil pattern, and the first and the second insulating films, wherein the first insulating film comprises a first insulating material having a greater adhesive strength than the second insulating film, and the second insulating film comprises a second insulating material having a greater breaking strength than the first insulating film.

2. The inductor device of claim 1, wherein the coil pattern is formed in an elliptical shape.

3. The inductor device of claim 1, wherein the first insulating film is made of a material having a greater adhesive strength than a material of the second insulating film.

4. The inductor device of claim 1, wherein the second insulating film is made of a material having a greater breaking strength than a material of the first insulating film.

5. The inductor device of claim 1, wherein the first insulating film and the second insulating film are formed using initiated chemical vapor deposition (iCVD).

6. The inductor device of claim 1, wherein a circuit pattern and a via are disposed on the insulating layer.

7. The inductor device of claim 1, further comprising a pair of external terminals disposed on external surfaces of the magnetic member and the pair of external terminals are electrically connected with the coil pattern.

8. The inductor device of claim 1, further comprising a through hole disposed to divide the insulating layer.

9. The inductor device of claim 1, wherein the first insulating film is a seed layer that comprises a silane polymer, an amine polymer, an imidazole polymer, a pyridine polymer, or a combination thereof, and the second insulating film comprises an organosilicon polymer, a superhydrophobic polymer, a hydrophilic polymer, or a hydrophobic polymer.

10. The inductor device of claim 1, wherein the first insulating film is disposed on an upper surface of the coil pattern, and the second insulating film is disposed along an upper surface of the first insulating film.

11. The inductor device of claim 10, wherein the first insulating film is disposed in direct contact with the insulating layer, and the first insulating film and the second insulating film are disposed in a continuous manner over the upper surface of the coil pattern, a side surface of the coil pattern, and the insulating layer.

12. The inductor of claim 11, wherein the first insulating film is disposed in a continuous manner over the upper surface of the coil pattern, the side of the coil pattern, and areas between the adjacent turns of the coil pattern, and the second insulating film is disposed in a continuous manner over the first insulating film and the upper surface of the coil pattern, the side surface of the coil pattern, and the areas between the adjacent turns of the coil pattern.

13. The inductor device of claim 1, wherein the coil pattern has a thickness of 100 to 200 μm.

14. The inductor device of claim 1, wherein the first insulating film comprises a first polymer, and the second insulating film comprises a second polymer different from the first polymer.

15. A method of manufacturing the inductor device of claim 1, comprising:

forming the coil pattern on the two opposing surfaces of the insulating layer;

forming the first insulating film and the second insulating film made of different materials on the coil pattern, the first insulating film surrounding the curved exterior of the coil pattern; forming the first insulating film and the second insulating film between the adjacent turns of the coil pattern; and forming the magnetic member to enclose the first insulating film and the second insulating film, the coil pattern, and the insulating layer, wherein the first insulating film comprises the first insulating material having a greater adhesive strength than the second insulating film, and the second insulating film comprises the second insulating material having a greater breaking strength than the first insulating film.

16. The method of claim 15, wherein the forming of the magnetic member comprises:

laminating a dry-film type sheet above and below the insulating layer; and pressing and curing the dry-film type sheet.

17. The method of claim 16, wherein the dry-film type sheet comprises a composite of polymer with ferrite or metallic magnetic powder.

18. The method of claim 15, wherein the first insulating film is made of a material having a greater adhesive strength than a material of the second insulating film.

19. The method of claim 15, wherein the second insulating film is made of a material having a greater breaking strength than a material of the first insulating film.

20. The method of claim 15, wherein the first insulating film and the second insulating film are formed using initiated chemical vapor deposition (iCVD).

21. The method of claim 20, wherein the iCVD uses a peroxide of tert-butyl peroxide (TBPO) or tert-amyl peroxide (TAPO) as an initiator.

22. The method of claim 15, further comprising forming a circuit pattern and a via on the insulating layer.

23. The method of claim 15, further comprising forming a pair of external terminals on external surfaces of the magnetic member, wherein the pair of external terminals are electrically connected with the coil pattern.

24. The method of claim 15, wherein the forming of the first insulating film comprises forming the first insulating film by depositing the first insulating film on the coil pattern and a portion of the insulating layer where the coil pattern is not formed.

25. The method of claim 15, further comprising forming the first insulating film in direct contact with the insulating layer, and further forming the first insulating film and the second insulating film in a continuous manner over an upper surface of the coil pattern, a side surface of the coil pattern, and the insulating layer.

26. The method of claim 15, wherein the coil pattern has a thickness of 100 to 200 μm.

* * * * *